United States Patent [19]

Honda et al.

[11] 4,323,391

[45] Apr. 6, 1982

[54] PROCESS FOR RECOVERING ZINC

[75] Inventors: Tsuneo Honda; Haruo Nishina; Shuichi Uehara, all of Annaka, Japan

[73] Assignee: Toho Aen Kabushiki Kaisha, Tokyo, Japan

[21] Appl. No.: 51,990

[22] Filed: Jun. 25, 1979

Related U.S. Application Data

[63] Continuation of Ser. No. 915,672, Jun. 15, 1978, abandoned, and a continuation of Ser. No. 794,366, May 6, 1977, abandoned.

[30] Foreign Application Priority Data

May 20, 1976 [JP] Japan ..... 51-57256

[51] Int. Cl.[3] ..... C22B 4/02

[52] U.S. Cl. ..... 75/14; 75/88

[58] Field of Search ..... 75/14, 88

[56] References Cited

U.S. PATENT DOCUMENTS 2,127,633 8/1938 Najarian ..... 75/14

3,262,771 7/1966 Ban ..... 75/14

*Primary Examiner*—M. J. Andrews

*Attorney, Agent, or Firm*—Kane, Dalsimer, Kane, Sullivan and Kurucz

[57] ABSTRACT

Zinc is advantageously recovered by mixing a zinc-containing material with a bituminous coal etc. to form briquettes, dry distilling the said briquettes to form coked lumps and electrothermically distilling the said coked lumps in an electrothermic distillation furnace.

16 Claims, 4 Drawing Figures

PROCESS FOR RECOVERING ZINC

This is a continuation of Ser. No. 915,672, filed June 15, 1978, now abandoned, and a continuation of Ser. No. 794,366, filed May 6, 1977, now abandoned.

BACKGROUND OF THE INVENTION

1. Field of the Invention

The present invention relates to a process and an apparatus for smelting zinc and, more particularly, to a process for advantageously recovering zinc from zinc-containing materials by electrothermic distillation, and an apparatus for carrying out the said process.

2. Description of the Prior Art

It is known that zinc content in zinc-containing materials containing oxidic zinc such as zinc oxide, zinc ferrite, zinc silicate and zinc carbonate, for example, roasted zinc ore, leach residue from the hydrometallurgical refining of zinc, zinc-containing flue dust of steel and iron production and so on, can be recovered by converting them into sintered ore and thereafter subjecting them to electrothermic distillation. According to continuous electrothermic distillation under the use of a shaft-type electrothermically distilling furnace, the zinc-containing material and others are introduced continuously into the top of the furnace and then an electric current is conducted through this furnace charge to proceed with reductive distillation by the Joule's heat, while discharging the so treated furnace residue from lowest part of the furnace. The continuous distillation method described above has such advantages as higher yield of zinc recovery, higher efficiency of energy utilization and so on.

In such electrothermic distillation method, zinc-containing starting material is usually used, which is obtained by sintering and briquetting raw zinc-containing materials available generally in pulverous form and then subjecting them to dressing or size regulating so as to attain strength and gas permeability suitable to be used as the furnace charge as well as uniform subsidence in the furnace. An equal amount of coke lumps with suitable grain size is simultaneously introduced as a reducing agent for preventing sinters or briquettes from adhering to each other and in order to obtain increased electric conductivity and to maintain a suitable electric resistance. This method of using the sinters or briquettes has however a shortcoming in that the reaction rate of reductive distillation is controlled by the diffusion of the reaction-participating substances, for example, carbon monoxide, carbon dioxide, zinc and so on, within the sinters or briquettes, and therefore, it takes a relatively longer period of time for this reaction, i.e., in other words, only a relatively low productivity can thereby be achieved. The method also shows difficulties such as a larger amount of recycling ore or coke, a larger consumption of coke, necessity of the crushing and size regulating steps in the preparation of the sinters or briquettes and so on. In addition, it becomes also a problem that it may not be avoided to take countermeasures against accompanying dust evolution and environmental deterioration due to the possible sulfur content in the flue gas.

Attempts have been made to eliminate the sintering process and to use the briquettes in which the zinc-containing material is merely mixed with pulverized coke. Also for the binding agent to impart to the briquettes strength capable of withstanding the operating conditions, many have been investigated, however, few could have been found their use for the charge of the shaft-type electrothermically distilling furnace, because of lack of electric conductivity.

On the other hand, a method has also been known, in which briquetted ore obtained from mixture of roasted zinc ore, coal fine and cement mortar etc. is subjected to dry distillation before it is treated by reductive distillation in a vertical retort under external heating by utilizing its higher thermal conductivity. This method, however, owing to the restriction from the heat transfer distance and the thus required limitation of the scale of practical apparatus, cannot be realized in a practical furnace having large capacity. Moreover, a further disadvantage comes forth by the inferior thermal efficiency due to external heating, so that an unprofitable results may be anticipated when applied for, in particular, low-grade zinc-containing material.

SUMMARY OF THE INVENTION

The present invention has been reached through researches and investigations carried out under the essential purposes to increase the efficiency and productivity of reductive distillation of the zinc-containing material, to increase the economy of the whole operation by eliminating the sintering process which has been unavoidably concomitant with conventionally employed electrothermic distillation method, to realize an advantageous treatment of the low-grade zinc-containing materials, to simplify the total arrangements and to attain the efficient utilization of energy.

Thus, the present invention provides a process for recovering zinc under the use of a shaft-type electrothermically distilling furnace, which comprises the following essential steps:

(a) mixing a bituminous material or similar material, which has the nature of coking by dry distillation, with a zinc-containing material to form briquettes, (b) dry distilling the said briquettes to convert them into coked lumps, and (c) electrothermically distilling the said coked lumps to obtain zinc.

Further, the present invention provides an apparatus for carrying out the said process.

DETAILED DESCRIPTION OF THE PREFERRED EMBODIMENTS OF THE INVENTION

Figure 1:
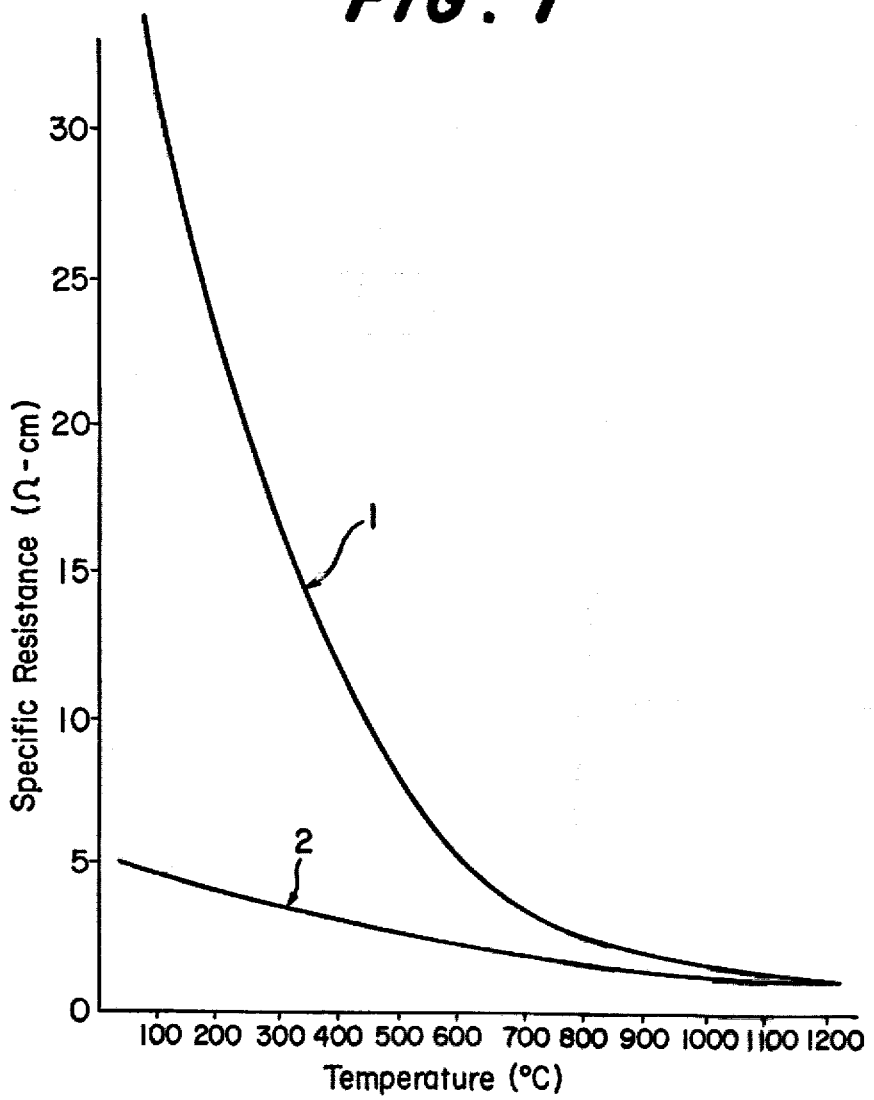
FIG. 1 shows an apparent specific resistance of the coked lumps used in the present invention.

In the process according to the present invention, the zinc-containing material is mixed with a carbonaceous material capable of being coked by dry distillation, such as for example, bituminous coal etc. to form briquettes. The zinc-containing material contains, as mentioned above, oxidic zinc and gives off zinc by reduction thereof. It may be practically such as for example, roasted zinc ore, zinc-leach residue, zinc-containing flue dust of iron production or so on, which is regardless of the sort thereof, coked with bituminous coal to establish electric conductivity.

As the carbonaceous materials for this purpose, regardless of the quality or grade, a bituminous coal or similar material (hereinafter referred to as "bituminous coal etc."), which has the nature of coking by dry distillation, may be used. Thus, there can be used, for example, coking coals rich in bitumen and served for manufacturing coke, petroleum pitch served for the production of form coke and even the coal preparation tailing of bituminous coal which occurs in the coal mining industry and which was heretofore abandoned without finding its utilization owing to the higher ash content.

The proportion of the bituminous coal etc. mixed may lie, for coal, from 5 to 40% and preferably from 10 to 30%. If it is below 5%, the gas permeability, strength and electric conductivity of the so obtained coked lumps may be insufficient and, at the proportion of above 40%, the amount of furnace charge may have to be increased due to the decrease of the concentration of zinc and, in addition, the strength of coked lump will be markedly decreased during the following distillation step, so that it becomes easy to break down.

It is also to be pointed out that an amount of fixed carbon of 1.0–1.2 times the stoichiometrical amount is required for the reduction of zinc oxide and iron oxide in the zinc-containing material. Therefore, if the fixed carbon content of the bituminous coal etc. is insufficient therefor, the supplement of such as coke fine may be necessary.

In the briquettes formed according to the present invention, calcium in a form of such as limy material may preferably be present. The existence of calcium facilitates the increase of the strength of the briquettes by combining with silicates contained, and contributes to form the porous structure of the briquettes in the dry distillation coking step, which will be explained afterwards, so that the yield of zinc recovery in the distillation step will thereby be improved.

Specifically, the present inventors have found that the yield of recovery of zinc can be increased to 90% or above by adding limy materials in the case of using a zinc-containing material such as leach residue containing several percent of sulfur, whereas the yield of zinc recovery decreases in linear proportion by the addition of siliceous material such as cement mortar instead of adding limy materials. While the sulfur contained in the mixture is fixed as iron sulfide in the presence of iron, the lime has a function to fix the sulfur as more stable calcium sulfide within the coked lump. The preferred amount of the lime can be determined by the basicity of the briquettes, more simply by lime-silica ratio $CaO/SiO_2$, and it must be more than 0.7 and preferably more than 1.1. In case of the shortage of CaO, lime stone etc. have to be supplemented in account of the amounts of CaO and $SiO_2$ in the zinc-containing material and in the bituminous coal etc.

In case of flue dust of iron and steel production, there are some, in which high content of CaO exists originally and no lime supplement may be necessary.

The briquettes are produced using a briquetting machine. Therefore, since those having a uniform size are produced, there is no necessity of crushing and size regulating procedures after coking by dry distillation and also there is no occurent of recycling material that accompanies these procedures, as compared with the case of using sinters or ore. Thus, a marked improvement in the economy of the whole operation can be attained.

It is preferable that the briquettes have enough strength to withstand the operation conditions during the dry distillation coking step, so that a briquetting pressure in the range from 300 to 2000 kg/cm$^2$ may practically be adopted. If it is below 300 kg/cm$^2$, it becomes necessary to add some water for retaining the strength and, if it is above 2000 kg/cm$^2$, there appears a tendency of laminar cleavage of briquettes due to the spring back, i.e. recoil swelling upon relaxation of the pressure.

The briquettes may have any shape, such as for example, rectangular, loaf, almond-like and cylindrical shapes etc. However, such shapes as small rectangular piece and almond-like piece may be preferred from the point of view of heat transfer. The dimension of the smallest portion should be greater than 5 mm. If it is below 5 mm, the uniform subsidence of furnace charge becomes difficult and so-called "scaffold" may be apt to occur. In view of heat transfer, briquettes are preferable to be larger in size within the permissible range of mechanical strength.

The briquettes thus formed are introduced into a dry distillation coking furnace and, by dry distilling at a temperature from 600° to 1100° C., preferably above all from 800° to 1000° C., it becomes electrically conductive and at the same time the strength thereof is also increased sufficiently. Thus, there is obtained a charge material suitable for introducing into the electrothermically distilling furnace.

The electric conductivity of the briquettes according to the present invention is developed by dry distillation coking and the coked lumps obtained have an effective electric conductivity at higher temperatures. Though the reason therefor is not quite clear, it may be considered to have a correlation with the fact that the bitumen constituting a part of the coked lumps melts and flows at higher temperature.

Explaining further about this high temperature electric conductivity, it has, for example, been recognized, that the briquettes formed from a mixture of 70 parts of zinc-leach residue of below 20 mesh and 30 parts of coal preparation tailing of bituminous coal under a briquetting pressure of 500 kg/cm$^2$, exhibited, a high electric resistance of few hundreds KΩ-cm, whereas by progressively heating and dry distilling, they showed electric resistances of 2–3 KΩ-cm at heating temperature of 700° C., 8–12Ω-cm at 800° C. and 3Ω-cm at above 850° C. Furthermore, FIG. 1 shows the high temperature characteristic of apparent specific resistance of the coked lumps introduced into the shaft type electrothermically distilling furnace. In FIG. 1, curve 1 represents the apparent specific resistance of the coked lumps according to the present invention prepared from leach residue and coal powder by dry distillation at 900° C. and curve 2 represents the apparent specific resistance of a concomitant charge of coke lumps and sintered lumps consisting mainly of leach residue and used in the conventionally employed electrothermic distillation method. FIG. 1 shows that the apparent specific resistance of the coked lumps according to the present invention at temperature range of 850°–900° C. is almost equal with that of the above concomitant charge heated at 700° C. Thus it is clarified that by charging the coked lumps at higher temperature, electrothermic distillation can be carried out without any concurrent charge of coke.

As one of the advantages achieved by the present invention, it is to be pointed out that cadmium and chlorine in the zinc-containing materials can be removed at the dry distillation coking step by selecting suitable dry distillation temperatures. Thus, it has been shown that the cadmium could be evaporated during a short dry distillation period of 30–60 minutes in such rates: 30% at 700° C., 60% at 800° C., 70% at 900° C., 95% at 950° C. and almost completely at above 1000° C., so that the remaining concentration of cadmium in the coked lumps as well as the content of cadmium in zinc recovered in the following distillation by electric heating could be reduced below 0.01%. As to chlorine that may be contained in the zinc-containing materials, it was found that a remaining chlorine content can be decreased below 0.1% by carrying out dry distillation at temperatures of above 950° C., so that zinc products such as zinc oxide which are free from chlorine can easily be obtained.

It is often seen that zinc-containing materials usually contain sulfur, and therefore, in the prior sintering method, due to sulfur dioxide formed, it is necessary to use an expensive and costly installation for desulfurization of flue gas. In contrast thereto, according to the present invention, specifically the countermeasure against sulfur dioxide can be dispensed with, because sulfur fixation in the coked lump is achieved during the dry distillation coking step, as described previously.

For the dry distillation coking furnace according to the present invention, there can be adopted a shaft type furnace that has a simple construction. Thus, the shaft type furnace having externally a combustion chamber is charged with the briquettes formed according to the present invention from the furnace top and the charge is subjected to dry distillation by the heat from the combustion chamber progressively while it descends within the furnace. Though the heat required for dry distillation at normal conditions may be supplied by burning in the combustion chamber the organic volatile components evolved by dry distillation, i.e. the dry distilled gas, it may be preferred to furnish an auxiliary burner in case of heating at the starting of the operation or if dry distillation at higher temperature is required for removing cadmium and chlorine and so on.

It is also possible to carry out the dry distillation coking of the briquettes by the heat of combustion of the dry distilled gas and the reducing gas generated by the electrothermic distillation, in a spatial combustion chamber disposed directly on the top of the shaft type electrothermically distillating furnace.

The coked lumps obtained in the dry distillation coking step according to the present invention are then introduced into the shaft type electrothermically distilling furnace to undergo electrothermic distillation at 1000°–1400° C.

As explained previously, the coked lumps according to the present invention have a suitable electric conductivity at higher temperature, so that they can directly be subjected to electrothermic distillation. In case of charging the coked lumps according to the present invention at lower temperatures, however, it is possible to supplement an electric conductivity by simultaneously charging at least 10% by weight of pea coke. Since the pea coke in this case plays a function of supplementing the electric conductivity, it is not consumed as the reducing agent unlike in the prior method, so that it can be reused repeatedly.

As compared with the prior technique using sinters, in which the sinters substantially occupy only about 20–30% (excluding the coke and recycling ore) in the total charge introduced into the electrothermic furnace, the proportion of the zinc-containing material in the furnace charge according to the present invention reaches about 65–70%, because only a small amount of pea coke is required or they are even dispensable for the furnace charge, and the recycling ore does not come due to the pronounced reactivity of the furnace charge. Therefore, a remarkable increase in the operation capacity of the electrothermic furnace can be attained.

During the electrothermic distillation according to the present invention, the coked lumps exhibit an excellent reactivity so as to enable one to increase the efficiency of reductive distillation in a remarkable manner. This may be based on the facts that the finely dispersed zinc-containing material is contacted closely with the coke material by the dry distillation coking step according to the present invention and thus the zinc-containing material is kept in an easily redusible state and that the coked lumps themselves become porous by dry distillation so as to case the diffusion of the reaction substances, thus the reducing reaction being facilitated during the electrothermic distillation.

Figure 2:
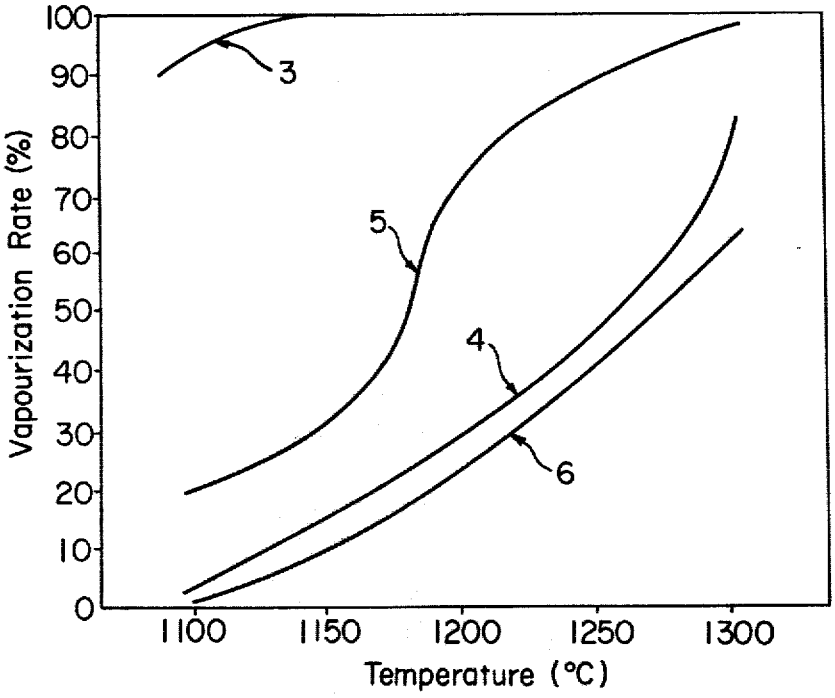
FIG. 2 shows the relationship between the vapourization rate (%) of zinc and lead and the electrothermic distillation temperature (°C.) of the coked lumps used in the present invention.

This may further be explained in FIG. 2, in which curves 3 and 5 show the vaporization rates of zinc and lead after heating for one hour the coked lumps according to the present invention, respectively, and curves 4 and 6 denote the vaporization rates of zinc and lead after heating for one hour the sinters used in the prior technique, respectively. It is clearly recognized that, in case of using sinters of the prior technique, zinc evaporates at 1100° C. only in an amount of about 3%, whereas, in case of electrothermic distillation using coked lumps according to the present invention, a 95% vaporization rate of zinc is reached, so that lower distillation temperature can be tolerated as compared with the prior technique and the process according to the present invention is advantageous with respect to thermal and time consumption.

By the way, it should be pointed out that the quite specific behavior of vaporization of lead in the coked lumps according to the present invention shown by curve 5 suggests the possibility of separation of zinc and lead or even of complete extraction of lead under the utilization of the present invention.

The process according to the present invention can be carried out by producing the coked lumps by means of a separately arranged dry distillation coking furnace and then introducing them into a shaft type electrothermic furnace. However, since the electric conductivity of the dry distilled coked lumps is effectively developed at higher temperature, as described above, it is necessary to supply simultaneously at least more than 10% of pea coke, when they are introduced into the electrothermic furnace at lower temperature of, for instance, below 600° C. Therefore, in respect of the efficient operation and of the energy economy, high temperature charging is preferable.

Such high temperature charging of the coked lumps can be realized in such a manner that the lower part of the dry distillation coking furnace is connected with the upper part of the shaft type electrothermic furnace, so that the hot dry distilled coked lumps can be smoothly transferred consecutively to the electrothermic distilling furnace without being cooled. It can be also realized in such a manner that a spatial combustion chamber is disposed directly on the dry distillation coking part of the shaft type electrothermic furnace by making the furnace body longer, and the dry distillation coking of the briquettes is carried out at the upper part of the electrothermic furnace, so that the hot coked lumps produced can smoothly be transferred consecutively to the electrothermically distilling part without being cooled. Such direct high temperature charging of the hot coked lumps exhibits technical advantages in that the heat retained in the hot coked lumps can effectively be utilized and that equipments such as a discharging machinery at the bottom of the dry distillation coking furnace and a charging machinery at the top of the electrothermic furnace etc. are dispensable, so that there becomes possible a fully continuous and automatic operation from the charging of briquettes to the discharging of the reduced ash.

Examples of the apparatus used according to the present invention are described below with reference to the attached drawings.

Figure 3:
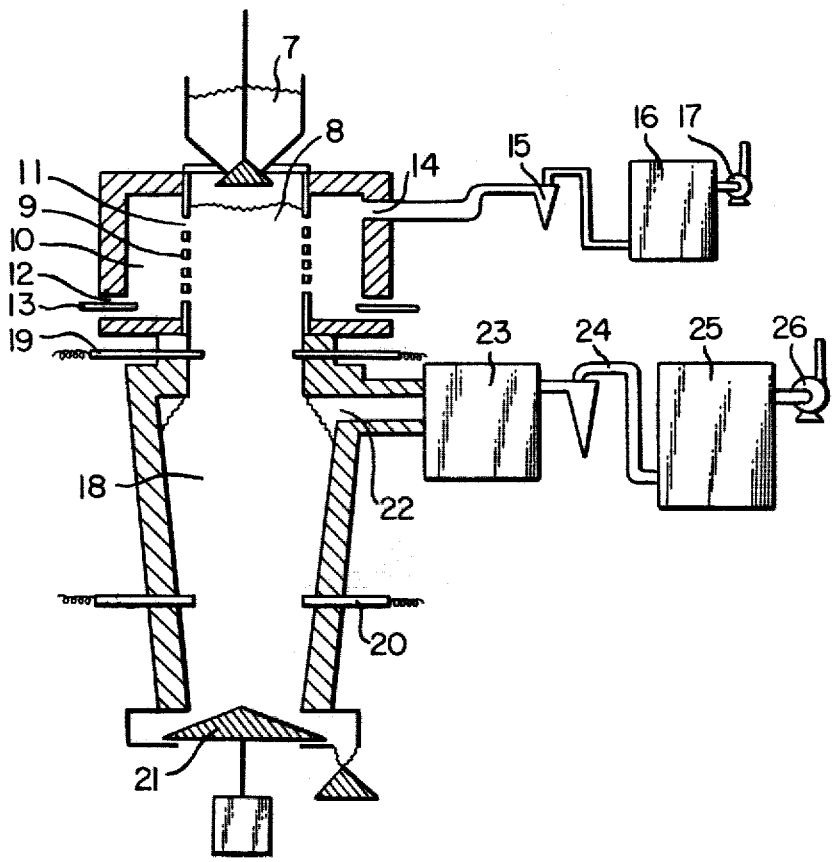
FIG. 3 shows an example of an apparatus for recovering zinc.

FIG. 3 is a schematic drawing of the shaft type electrothermic furnace, the upper part of which is adjoined to the lower part of a vertical dry distillation furnace, with accessory attachments.

The briquettes formed are supplied from the hopper 7 to the dry distilling section 8 of a shaft furnace. The dry distilling section 8 is a vertical cylinder and is separated from the externally disposed combustion chamber 10 by the surrounding heat conductive wall 9. The heat conductive wall 9 may be either a cylindrical construction made of heatconductive fire-resistant material or heat-resisting steel, or a construction in which pieces of heat-resisting steel are heaped together. The heat conductive wall 9 has many gaspermeating perforations 11, through which the dry distilled gas generated in the dry distillation section 8 blows out into the combustion chamber 10 and it is combusted by the air conducted from the air inlets 12 to serve as the heat source for dry distillations of the briquettes. Although dry distillation coking proceeds self-combustively, heating at the start of the operation is performed by means of the auxiliary burner 13 arranged in the outer wall of the combustion chamber 10. The auxiliary burner 13 is also used for supplementally heating the coked lumps in cadmium removal therefrom, as explained previously.

The combustion exhaust gas is passed through the exhaust gas flue duct 14 arranged in the outer wall of the combustion chamber 10, the cyclone separator 15, the bag filter 16 and the exhaustion fan 17, and discharged out from the apparatus. The flue dust of this exhaust gas, i.e. the coke dust, is separated and collected in the cyclone separator 15 and the bag filter 16.

The dry distilled coked lumps having a temperature of, for example, 800°-1000° C., descend with the subsidence of the charge caused by the discharging of the reduced ash from the bottom of the electrothermic furnace 18 and are transferred to the electrothermic furnace 18. The electrothermic furnace 18 is equipped with a plurality of upper carbon electrodes 19 and a plurality of lower carbon electrodes 20 and the coked lumps inside the furnace is subjected to reductive distillation by the Joule heat of an electric current supplied through the electrodes.

The vapour of zinc evolved gathers to the vapor ring 22 disposed in the middle or upper part of the electrothermic furnace 18 and then blows out into the oxidizing chamber 23, in which it is oxidized by excessive air to form zinc oxide. It is separated and collected by the cyclone separator 24 and the bag filter 25. The exhaust gas from the bag filter 25 is discharged out through the exhaustion fan 26. In this drawing, the oxidizing chamber 23 is installed for recovering zinc as zinc oxide, and hence, it may of course be possible to obtain zinc dust or zinc metal by installing a condenser instead of the oxidizing chamber 25.

After the reductive distillation, the reduced ash is continuously discharged from the furnace bottom by means of the rotary discharger 21.

Figure 4:
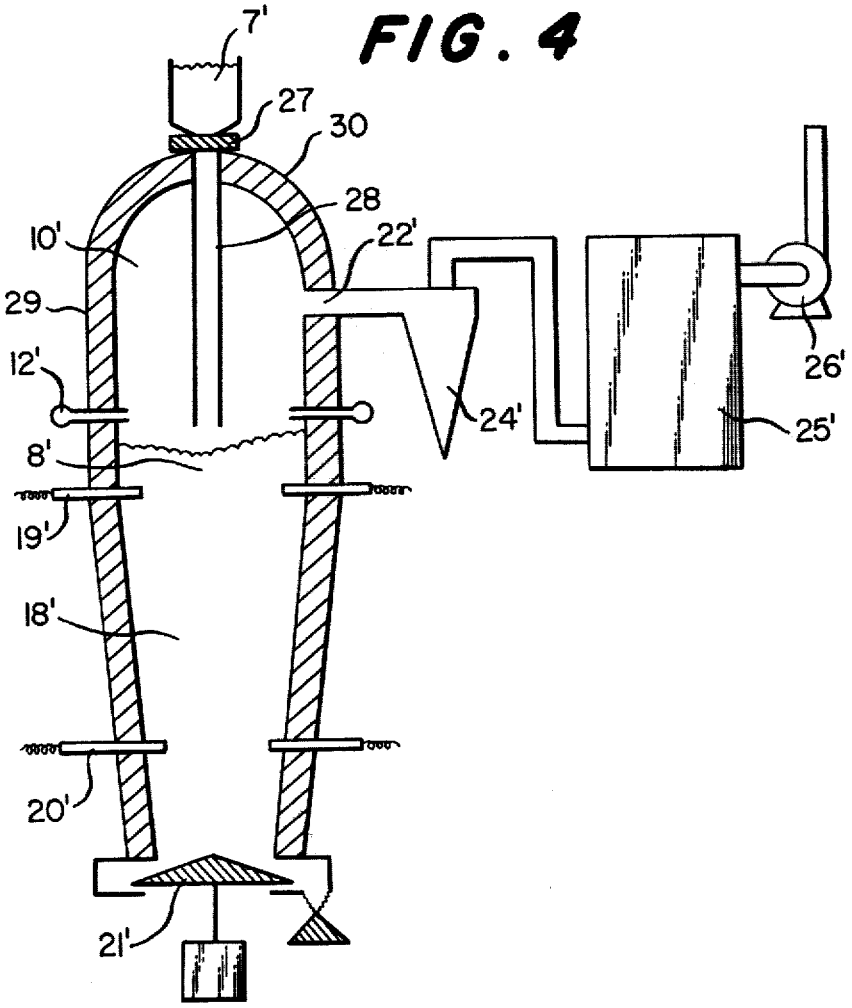
FIG. 4 shows another example of an apparatus for recovering zinc.

FIG. 4 shows another example of the apparatus to be used for carrying out the process according to the present invention, in which a shaft type electrothermic furnace having a combustion chamber at the upper part thereof is schematically illustrated together with accessories.

The upper part of this furnace is provided with the combustion chamber 10 by extending upwards the furnace body of the conventional electrothermic furnace and the chamber 10 is served for the dry distillation coking of briquettes. By this apparatus, it is also possible to carry out the dry distillation coking of the briquettes and the electrothermic distillation of the coked lumps continuously.

The combustion chamber 10' is adjoined directly to the electrothermic furnace 18'. The combustion chamber 10' is constituted from the side wall 29 of cylindrical shape or of polygonal tube and the dome wall 30. At relatively lower part of the side wall 29, a plurality of the combustion air inlets 12' and, at relatively upper part thereof, the flue duct 22' for exhaust gas are provided.

The formed briquettes in the hopper 7' are passed through the constant-weight feeder 27 and the chute 28 to the dry distilling coking zone 8' on the upper carbon electrodes 19'. The high temperature reducing gas generated in the electrothermic furnace 18' streams up to the upper combustion chamber 10' while heating the briquettes. In the combustion chamber 10, the high temperature reducing gas is, together with the dry distilled gas evolved simultaneously from the briquettes, oxidatively combusted by the air conducted from the combustion air inlets 12' and the briquettes are dry distilled and coked by the radiant heat produced by combustion. The dry distilled coked lumps descend in accordance with the subsidence of the furnace charge corresponding to the discharging of the reduced ash from the furnace bottom by the rotary discharger 21' and reach at the electrothermic zone, in which they are subjected to electrothermic distillation by the conduction of electric current between the upper and lower carbon electrodes 19' and 20'.

The distilled reducing gas evolved consists mainly of CO, $CO_2$ and zinc and contains usually some Pb, Cd etc., which is oxidatively combusted in the combustion chamber 10', as described above. The zinc vapor is oxidized to zinc oxide in the combustion chamber 10'. Zinc oxide together with other gases is passed through the exhaust gas flue duct 22' disposed in the side wall of the combustion chamber 10' to the cyclone separator 24' and the bag filter 25', where it is separated and collected. The remaining gases are exhausted through the exhaustion fan 26'.

By using the above mentioned furnace, it is also possible, as in the furnace shown in FIG. 3, to carry out the charging of briquettes, the zinc recovery and the discharging of reduced ash continuously and automatically. Further, the furnace of this type is more simple in its construction and enables more efficient utilization of energy, so that it is extremely economical as an apparatus for obtaining zinc oxide from zinc-containing materials.

Moreover, according to the present invention, since the coked lump exhibits excellent reactivity and recycling ore and pea coke are almost dispensable, there can be attained a greater proportion of coked lumps, i.e. the zinc-containing material, in the electrothermic furnace and a higher treating capacity. This means that the process according to the present invention can advantageously be adopted for the treatment of zinc-containing materials having relatively low zinc content, for instant, leach residue of hydrometallurgical refining and zinc-containing flue dust of steel and iron production. The above leach residue consists mainly of zinc ferrite, which is difficultly soluble in acid, and contains usually 15–28% of zinc. The leach residue occurs as a cake containing 30–40% of water. Zinc can be recovered from this residue in such a manner that the residue is dried using a dryer such as a rotary dryer and 65 parts of this dried residue is mixed with 20 parts of powdered bituminous coal, 5 parts of pulverized coke and 10 parts of lime stone powder to form briquettes and the so obtained briquettes are subjected to dry distillation coking and to electrothermic distillation. In case of adopting the process according to the present invention in a hydrometallurgical zinc refinery, it may be possible that a part of zinc is recovered as zinc dust to be used as the purification agent in the hydrometallurgical process and the rest of zinc is recovered as zinc oxide. In this case, assuming the monthly production of electrolytic zinc of 10,000 tons, amount of metallic zinc dust required for the purification stage in such a plant may amount to 400–800 tons/month, which corresponds to about $\frac{1}{2}$ to $\frac{1}{3}$ of the amount of zinc recovered from the leach residue, so that it is advantageous to employ above mentioned way of recovering zinc. Moreover, a part of sulfur contained in the leach residue is fixed by calcium in the coked lump and the remaining part of it may also be fixed in the reduced ash by the possible iron content, so that no sulfur goes into the dry distilled gas or the reducing distilled gas.

In iron and steel production, zinc and lead contained in or going along with the iron ore or iron scrap is progressively concentrated during the process and so-called flue dust of iron and steel production containing about 15–40% of zinc is formed. Such a flue dust may efficiently be treated by the process according to the present invention. Thus, for example, in case of recovering zinc in such a manner that 70 parts of such flue dust is mixed with 20 parts of pulverous coal preparation tailing and 10 parts of lime stone powder to form briquettes and those briquettes are then treated in a dry distillation coking-electrothermically distilling furnace, the chlorine usually contained in flue dust of iron refinery is removed at the dry distillation coking stage by employing a dry distillation temperature of above 950° C. and the lead is vaporized as much as possible by selecting an electrothermically distilling temperature of above 1300° C., so that zinc and lead, being free from the chlorine, can effectively be recovered.

The reduced lumps from which zinc and lead have been removed consist mainly of metallic iron, so that such flue dust of iron refinery is easily reused as the raw material of iron production.

As described above, according to the present invention, it becomes now possible to increase the yield of zinc from zinc-containing materials in a pyrometallurgical process, to economize the marked amount of electric heating energy, to rationalize the workability and installations owing to the elimination of the sintering step, to treat low-grade zinc-containing material effectively and so on, so that remarkable advantages have been reached by the present invention.

The process according to the present invention is further explained by the following examples.

EXAMPLE 1

A leach residue containing 30–40% of water from hydrometallurgical zinc refinery is dried preliminarily by a rotary dryer to a water content of below 10%.

65 parts of said dried residue containing 20.5% of Zn, 31.2% of Fe, 4.5% of $SiO_2$, 1.6% of CaO and 4.2% of S is mixed with 20 parts of a coal preparation tailing of 30 mesh or below containing 27.0% of fixed carbon, 36.0% of volatile components, 1.6% of S and 34.5% of ash (43.4% $SiO_2$, 11.5% CaO), 5 parts of pulverous coke containing 88% of fixed carbon, 2% of volatile components and 10% of ash and 10 parts of lime stone powder of 98.7% purity. By using a briquetting machine of a type of double wheel (tire diameter 500 mm, briquetting pressure 500 kg/cm$^2$), the mixture is molded into almond-shaped briquettes having a size of 25×25×20 mm, which is then introduced into the vertical electrothermic furnace shown in FIG. 4 (furnace inner diameter: 1.95 m, height of combustion chamber: 3.6 m, distance between the upper and lower electrodes: 8 m and electric current for heating: 9000 Amp.) and heated by electric current.

The temperature in the combustion chamber reaches above 1200° C., by combusting the dry distilled gas from briquettes and the high temperature reducing gas consisting mainly of carbon monoxide and zinc, which blows out from the electrothermically distilling zone, in the combustion chamber at the upper part of the furnace, while the briquettes are converted into coked lumps by the radiating heat by said combustion.

The red hot coked lumps descend with the subsidence of the furnace charge caused by the discharging of the reduced ash from the rotary discharger 21' and thus, move to the electrothermic distilling zone 18', where they are heated to 1150° C. by the electric current between each 4 pairs of upper and lower electrodes 19' and 20' to effect the reducing distillation of zinc.

The evolved zinc vapor is recovered in a form of zinc oxide by oxidizing it.

In this Example, corresponding to 1000 kg of leach residue in the briquettes introduced, there are obtained 270 kg of zinc oxide with a purity of 88.9% and 771 kg of reduced ash containing 1.61% of Zn, 6.01% of S, 14.51% of CaO, 11.72% of $SiO_2$ and 40.45% of Fe.

In this Example, the power consumption per 1 ton of the zinc oxide amounted to 3,050 KWH, which was considerably lower, as compared with 5,700 KWH in the prior process, so that it was recognized that marked economization in power consumption had been attained. By the way, this value of power consumption corresponds to 3,819 KWH when converted into the value per ton of metallic zinc. However, in consideration of the raw material being of low-grade, the above value can be contrasted with 3,350 KWH, which was obtained in a prior process using roasted zinc ore of high zinc content.

It is thus recognized that the process according to the present invention is a more advantageous process for recovering zinc as compared with the prior process.

EXAMPLE 2

An apparatus having a construction corresponding to FIG. 3 was employed (furnace inner diameter: 30 cm, height of dry distillation coking chamber: 1 m, height of electrothermically distilling part: 3.5 m, power requirement: 60 KVA). As the zinc-containing material in the briquettes there was used a dried leach residue containing 20.1% of Zn, 32.3% of Fe, 4.8% of $SiO_2$, 1.3% of CaO, 4.5% of S and 0.13% of Cd. The dry distillation coking and electrothermic distillation were carried out while keeping the temperature of dry distillation coking section at 970° C. by means of an auxiliary burner.

In correspondence to 1000 kg of leach residue in the briquettes charged, there were obtained 230 kg of zinc oxide containing 97.5% of ZnO and below 0.01% of Cd as well as 65 kg of coked dust containing 19.0% of Zn and 2.0% of Cd. This shows that all the cadmium had been volatilized during the dry distillation coking step and collected in the coking dust.

EXAMPLE 3

A flue dust collected in a bag filter during the production of reduced iron pellets from 2 blast furnace dust was used as the starting zinc-containing material. 70 parts of this flue dust was mixed with 20 parts of coal preparation tailing of below 20 mesh as in Example 1 and 10 parts of lime stone powder as in Example 1 to form briquettes of the same shape and size as in Example 1.

The so obtained briquettes were introduced into the dry distillation coking-electrothermically distilling furnace same as in Example 2. The temperature of the dry distillation coking section was kept at 950° C. by employing an auxiliary burner and the temperature of the electrothermically distilling section was held at 1300° C. by adjusting the electric current fed.

With respect to 1,000 kg of the iron flue dust, 308 kg of zinc oxide, 62 kg of coking dust and 625 kg of reduced ash were obtained at residence time in the furnace of 6 hrs.

Composition of each of the raw materials and products are given in Table 1.

TABLE 1

| | C % | Zn % | Fe % | Pb % | $SiO_2$ % | CaO % | Cl % |
|---|---|---|---|---|---|---|---|
| flue dust | 9.2 | 26.3 | 23.7 | 2.3 | 4.1 | 3.2 | 1.4 |
| coal preparation tailing | *27.0 | — | — | — | 15.0 | 4.0 | — |
| zinc oxide | — | 75.5 | — | 3.6 | — | — | <0.01 |
| coking dust | — | 15.1 | — | 14.5 | — | — | 23.0 |
| reduced ash | — | 0.3 | 37.9 | 0.3 | 13.4 | 19.6 | <0.01 |

*fixed carbon

It was found that at the dry distillation coking temperature of 950° C., all the chlorine in briquettes had been transferred to the coked dust and the chlorine in zinc oxide laid below 0.01%. It was also shown that at the electrothermally distilling temperature of 1,300° C., most part of zinc and lead had been evaporated and that reduced ash containing about 80% of iron and lower amounts of zinc and lead could be obtained, which are capable of being utilized effectively as the raw materials for iron production.

What is claimed is:

1. A process for recovering zinc or zinc oxide from zinc containing materials with the use of a shaft type electrothermically distilling furnace, which comprises:

(a) mixing a bituminous material with a zinc-containing material;

(b) forming briquettes from the mixed material;

(c) dry distilling the bituminous material containing briquettes to convert them into coked lumps;

(d) electrothermically distilling the bitumin containing coked lumps to obtain zinc vapor; and (e) recovering zinc from said vapor.

2. Process according to claim 1, wherein the said zinc-containing material is selected from the group consisting of roasted zinc ore, leach residue from the hydrometallurgical refining of zinc, and zinc-containing flue dust of steel and iron production.

3. Process according to claim 1, wherein the said bituminous material is selected from the group consisting of bituminous coal, bituminous coal preparation tailing, and petroleum pitch.

4. Process according to claim 3, wherein the amount of the bituminous material mixed with the zinc-containing material is 5 to 40% by weight.

5. Process according to claim 1, wherein the dimension of the smallest portion of the briquettes is at least 5 mm.

6. Process according to claim 1, wherein dry distillation is carried out at 600° to 1100° C.

7. Process according to claim 1, wherein cadmium is removed by carrying out dry distillation at 850° to 1100° C.

8. Process according to claim 1, wherein chlorine is removed by carrying out dry distillation at 950° to 1100° C.

9. Process according to claim 1, wherein electrothermic distillation is carried out at 1000°-1400° C.

10. Process according to claim 1, wherein a limy material is added for the production of the briquettes.

11. Process according to claim 10, wherein the limy material is added in such an amount that the basicity of the briquettes is kept at more than 0.7.

12. Process according to claim 11, wherein the basicity is simply determined by $CaO/SiO_2$ ratio.

13. Process according to claim 4, wherein the amount is 10 to 30 percent.

14. Process according to claim 1, wherein said recovering is by condensing the vapor to obtain zinc.

15. Process according to claim 1, wherein recovering is by air oxidizing the vapor to obtain zinc oxide.

16. Process according to claim 11, wherein said basicity is kept at more than 1.1.

* * * * *